United States Patent [19]

Booker et al.

[11] 4,250,827

[45] Feb. 17, 1981

[54] BOAT MOORING DEVICE

[76] Inventors: William G. Booker, 3410 Peel St., Suite 1705, Montreal, Canada; Donald L. Bregoff, 2240 NE. 62 Ct., Ft. Lauderdale, Fla. 33308

[21] Appl. No.: 926,416

[22] Filed: Jul. 20, 1978

[51] Int. Cl.[3] ..... B63B 21/00

[52] U.S. Cl. ..... 114/230; 267/152

[58] Field of Search ..... 114/230; 9/30, 34, 35, 9/39, 40; 267/151, 152, 153, 141.6

[56] References Cited

U.S. PATENT DOCUMENTS

| | | | |
|---|---|---|---|
| 2,294,674 | 9/1942 | Lord | 267/141.6 |
| 2,996,033 | 8/1961 | Yordi | 114/230 |
| 3,084,517 | 4/1963 | Bell | 114/230 |
| 3,157,150 | 11/1964 | Faber | 114/230 |

*Primary Examiner*—Douglas C. Butler

[57] ABSTRACT

A boat mooring device comprising a base to be anchored to a dock or a platform on a yacht and including an upstanding coil spring having a bendable elbow zone and being connected to an extendible telescopic arm with a hook on the distal end to connect to a boat.

6 Claims, 7 Drawing Figures

Fig. 6
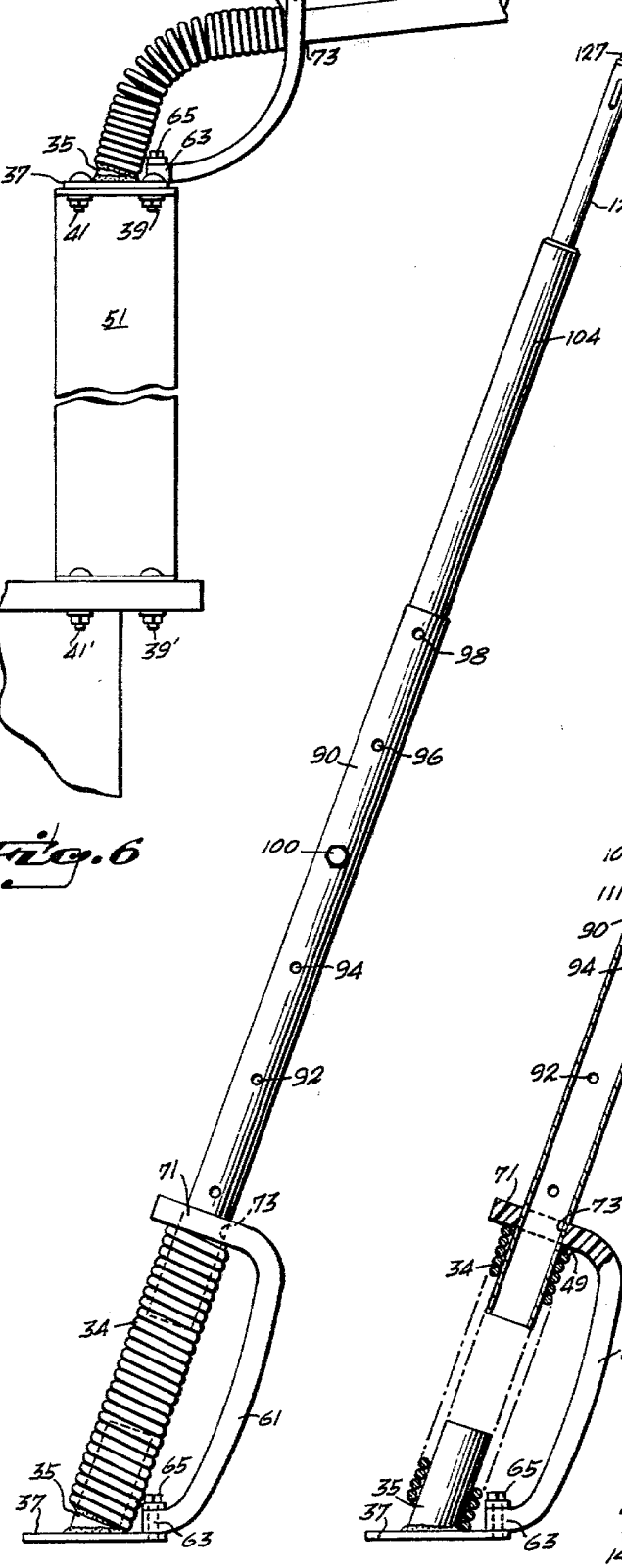
Fig. 3
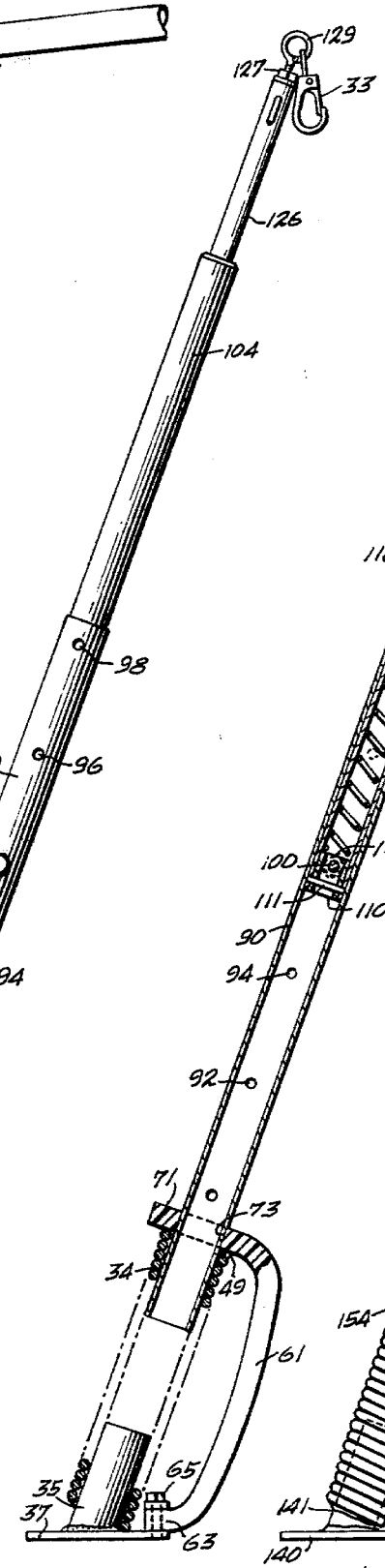
Fig. 4
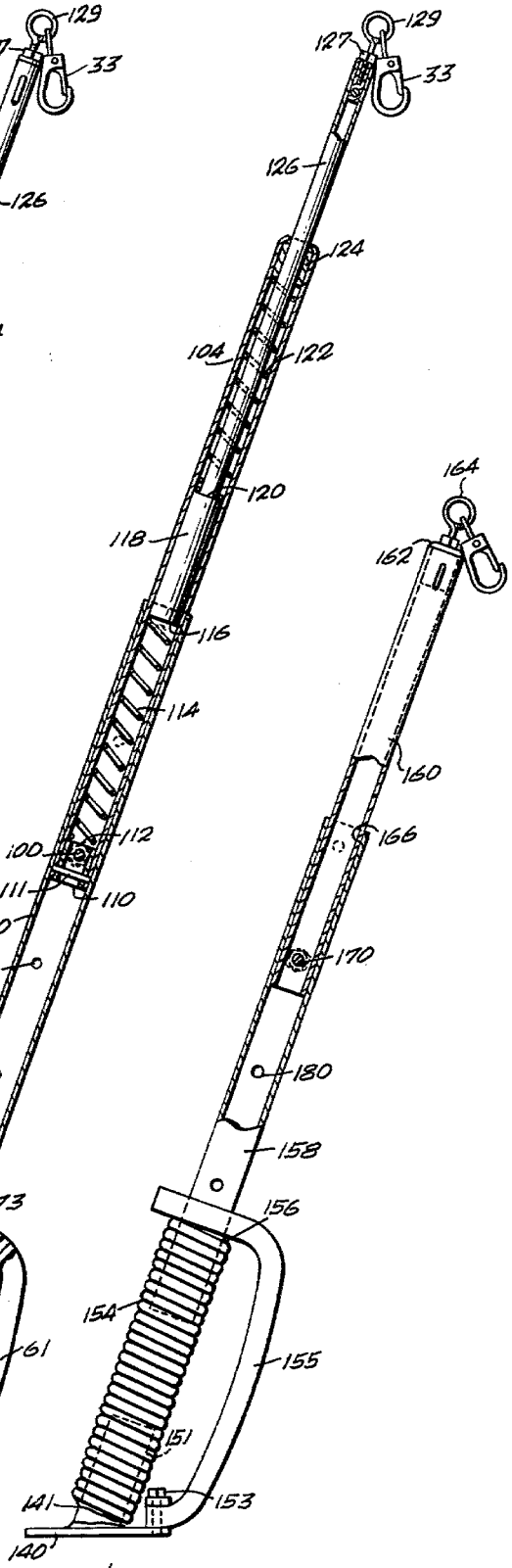
Fig. 5

BOAT MOORING DEVICE

FIELD OF THE INVENTION

This invention relates to a boat mooring device.

BACKGROUND OF THE INVENTION

In the past there have been numerous types of boat mooring devices such as that represented by U.S. Pat. No. 3,177,838 which includes a base with a stem and socket connection to an extendible telescopically engaged arm the distal end of which is adapted to connect to a boat and which may include shock absorbing means. This invention is of an improved device for mooring a boat to a dock.

Generally speaking this invention provides a boat mooring device which works on a push and pull principle through the use of mooring arms with high flexiblity as to the directional stress, both at the anchor point on the dock as well as at the attachment to existing fittings on a boat or yacht. The invention is of an attractive mooring device which may be made of stainless steel and, when not in use, is in a normal attitude generally out of the way ready for use in mooring a boat.

OBJECTS OF THE INVENTION

It is an object of this invention to provide a boat mooring device which is composed of a base to be anchored to a dock or platform at the stern of a yacht and which includes an outwardly extending arm composed of telescopic sections for extendibility and wherein an elbow joint in the form of a coil spring connects the arm to the base for flexing movement when connected to a boat. It is another object of this invention to provide a device of the type described in the preceding paragraph which includes shock absorber means for relative movement of adjustment of the telescoping arms in response to water current when the device is connected to a boat.

It is a further object of this invention to provide a boat mooring device of the type described which includes dampener means for reducing backlash or whipping action of the arms of the boat mooring device when a load is removed from it.

It is an overall object of this invention to provide an improved boat mooring device of the type described hereinafter which is simple and inexpensive to manufacture and which is very well adapted for the purposes intended whether for use on a dock or on a platform of a yacht to moor a dinghy to the yacht.

In accordance with these and other objects which will become apparent hereinafter, the instant invention will now be described with reference to the accompanying drawings, in which:

DESCRIPTION OF THE DRAWINGS

FIG. 3 is a view similar to FIG. 2 and illustrating the boat mooring device in a normal attitude when not connected to a boat as shown in FIG. 2;

FIG. 4 is a view in cross section of the device shown in FIG. 3;

FIG. 5 is a view similar to FIG. 3 which has been partly broken away, and which illustrates an alternative embodiment of the instant invention;

FIG. 6 is a slightly modified arrangement of the instant invention installed on the lip or edge of a dock.

DESCRIPTION OF THE PREFERRED EMBODIMENT

Figure 1:
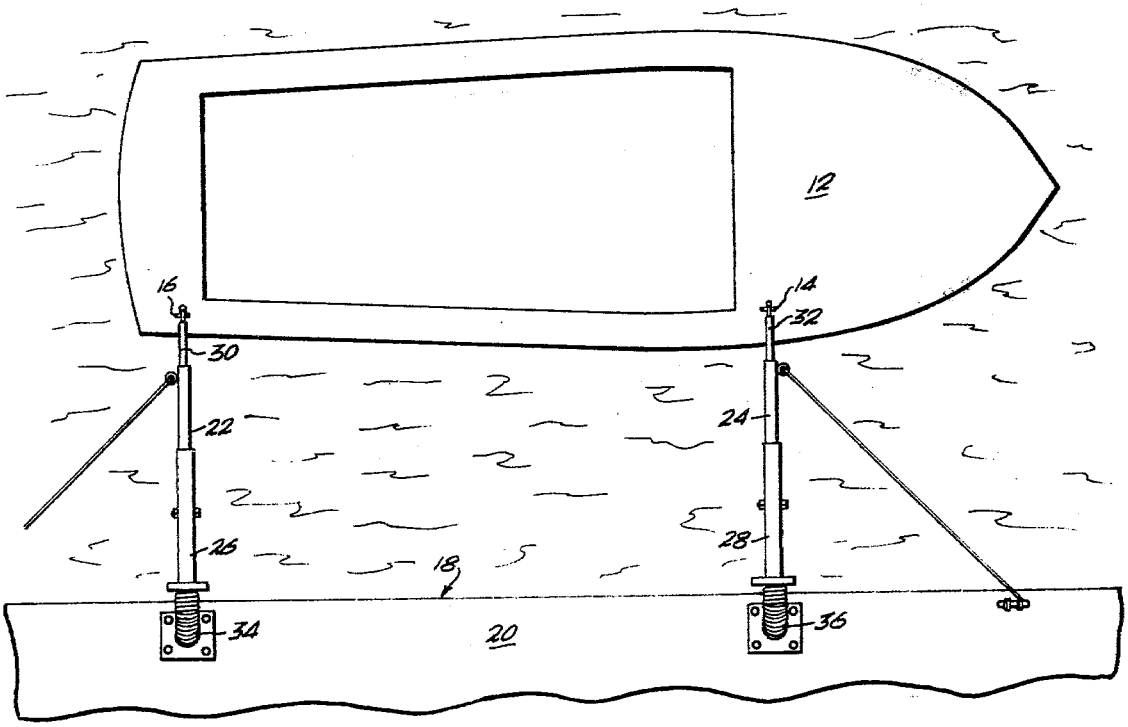
FIG. 1 is a plan view illustrating the use of the mooring device of the instant invention.
Figure 2:
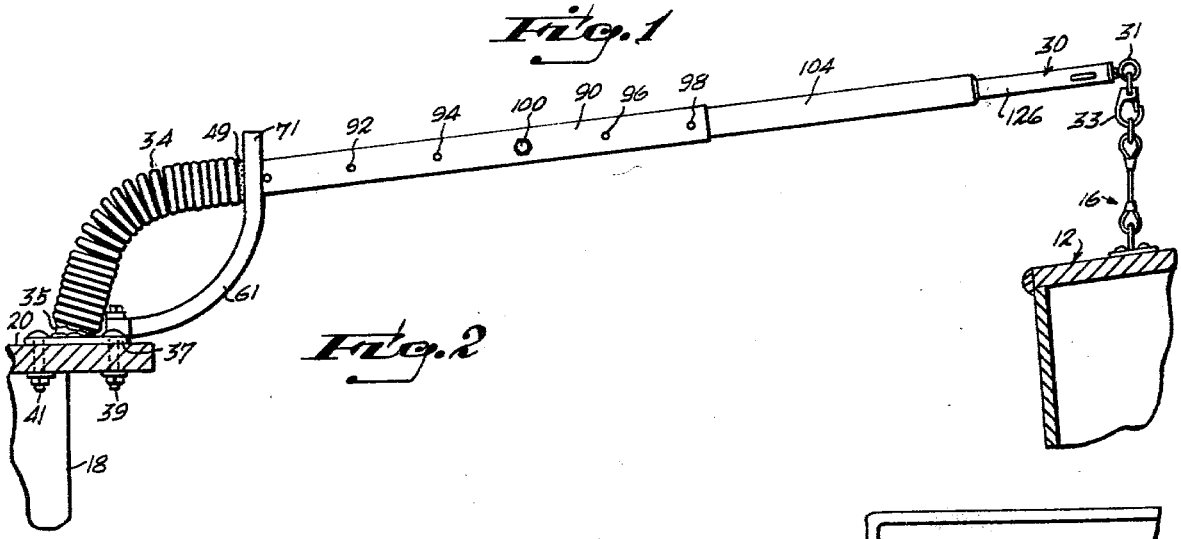
FIG. 2 is a side elevation view of one of the mooring devices shown in FIG. 1 and attached to a boat.

Referring to the drawings wherein like reference characters designate like or corresponding parts throughout the several views and referring first to FIG. 1, there is shown a boat generally designated by the numeral 12 which is connected adjacent the side 18 of a dock having an upper surface 20 by means of shackles or fastener means 14 and 16 which are connected to a pair of boat mooring devices generally designated by the numerals 22, 26 and 30 and 24, 28 and 32 respectively, the same being anchored to the dock surface 20 as indicated generally by the numerals 34 and 36. Referring specifically to FIG. 2, it is seen that the boat mooring device includes a base 37 with a lower surface to rest upon the upper surface 20 of the dock and that the base includes an upstanding stem 35 with the base being anchored by means of bolts and nuts such as 39 and 41 which extend through holes provided in the dock. Coiled about the stem is a spring 34 which is welded to the stem as shown at its inner end and at its upper end it is welded as at 49 to an inner arm 90 which is of tubular form and along which there are provided a plurality of spaced diametrical holes 92, 94, 96 and 98 to accommodate a headed bolt 100. It is seen that the inner end of the inner arms extends into the outer zone of the coil spring with the coil spring defining an elbow joint which is swingable between the position shown in FIG. 2 when it is connected to a boat 12 by the shackle or fastener means 16 to the hooked end 33 provided on the ring 31 fixed to the outer end of the outer arm 30 to the position shown in FIG. 3 illustrating the device in a normal attitude. Within the tubular member 90 there is telescopically received an outer arm generally designated by the numeral 30 which, in the preferred embodiment, is composed of an inner portion 104 and an outer portion 126. Referring now to FIGS. 3 and 4, it is seen that the outer arm 30 is composed of the outer portion 126 which is slidably received within the inner portion 104 and that the inner end 118 is enlarged so as to mate within the portion 104 and be slidable therein while there is provided a plug 112 fixed thereto by means of a pin 111 which extends through a hole in the wall 110 and the same is adpted to be positioned and held by means of a headed bolt 100 which is provided with a nut to keep it in the position shown in FIG. 4 relative to the inner arm. A spring 114 is captivated between the end 116 and the plug, see FIG. 2, and a second spring is captivated between the turned in plugged end 124 to captivate the spring 122. There is thus provided a piston zone 118 which is yieldably held between the two springs. The hooked end device generally designated by the numeral 129 includes a portion which is kept by the nut 127 within the outer distal end of the outer arm. In use, it is seen that when the base is anchored, the device will be in the normal position shown in FIGS. 3 and 4 and the same will be of a length which may be extended or adjusted by sliding the outer arm within the inner arm and fixing it in a position by means of the headed bolt and nut 100 passing through the hole in the inner arm and one of the holes such as 94 or 92, as selected. In this manner, when a boat is connected to the mooring device as shown in FIGS. 1 and 2 its position outboard from the dock may be predetermined. It is further seen that the elbow action of the spring 34 provides for flexing movement upwardly and downwardly with the water level as it varies with the tides through a substantial range above and below the attitude of the mooring device shown in FIG. 3 when a boat is connected to it and that movement of adjustment inwardly and outwardly may take place by means of the yieldability of the two springs captivated within the extendible outer arm.

Referring to FIG. 5 there is shown a device generally similar to the embodiment shown in FIGS. 3 and 4; however, the outer arm is not provided with the piston type extendible spring portion but, rather, is composed of a base 140 with an upstanding stem 141 which is adapted to be secured to a dock by means of the bolts 153 with the spring 151 being coiled about the stem and extending upwardly to an upper end zone 154 with an elbow joint being provided therebetween. From the spring and inner arm 158 extends with a plurality of holes, such as that designated by the numeral 180 spaced therealong and wherein the outer arm 160 is received within the inner arm and secured at a predetermined axial position by means of a headed bolt 170, similar to that previously described in reference to the bolt 100 of FIGS. 3 and 4. To the outer end, means for connection to a boat 164 are secured as indicated by the numeral 162.

Similarly, on reference to FIG. 6, it is seen that the base 37 with the spring welded to it as at 35 on the inner end and welded as at 49 to the arm may, in addition, be provided with the bolt 65 which is secured to a stanchion 51 by means of the bolts 39 and 41 with the stanchion in turn being secured to the dock side as indicated by the bolt and nut arrangement 41' and 39' for the purpose of elevating the base to accommodate special installations.

Figure 7:
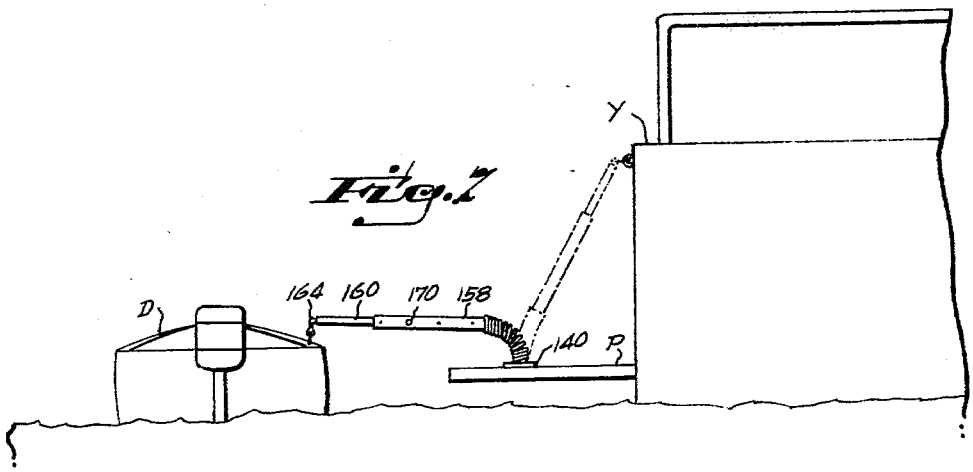
FIG. 7 is a partial view illustrating the use of the instant invention in mooring a small boat on a platform of a larger ship.

With reference to FIG. 7, it is seen that the device may be installed on a rear platform P of a yacht Y so that a dinghy D may be secured to it by means of fixing the base 140 to the platform P with the inner arm 158 and outer arm 160 being telescopically extendible and fixed by the bolt 170 so that the means 164 are adapted to connect to a cleat on a dinghy to hold it in position behind the yacht while it is anchored.

In a preferred embodiment the elbow spring is 8 to 12 inches long and the spring coils are of about ½ inch in diameter and the inside diameter of the spring is about 1½ to 2 inches while its outside diameter is preferably 3 inches and the base is between 6 and 8 inches square. The stem of the base extends into the spring a distance greater than 3 inches preferably and the inner arm extends into it similarly a substantial distance to provide for the flexing elbow action. While the dimensions will depend upon the particular installation, it is sometimes preferred that the spring have an overall length of 18 inches or longer. Additionally, the base spring and arm portions of the mooring device may be of stainless steel so as to take a high polish and be decorative.

A suitable fixed shackle is provided to the end of the arm and, preferably, the snap ring illustrated.

Because the spring is quite strong and the stainless steel tubing extends outwardly therefrom a substantial distance and is of a diameter of about 1 inch in many installations, substantial care must be taken when releasing the arm from a load. For this reason, in the preferred embodiment a dampener means is provided as shown in the drawings and designated in FIGS. 3 and 4 by the numeral 61. The dampener means is composed of a relatively thick strip of neoprene rubber designated by the numeral 61 which is preferably about 1 inch thick and provided with a collar 71 with a hole 73 therethrough to accommodate the inner end of the arm which may be about 2 inches thick where it is welded to the spring. The strip is about 2½ feet long in the preferred embodiment illustrated but, in any event, is of sufficient length so that it is adapted to be anchored as by the bolt passing through the end 61 to the base. As shown in FIG. 2, when a load is applied, it is seen that the neoprene strip is buckled but that when the load is removed, it is placed in tension so that when the load is removed, the backlash or whipping action of the arms is restrained so as not to swing rapidly and substantially beyond the position shown in FIGS. 3 and 4. Similarly, on reference to FIG. 5, the neoprene strip is designated by the numeral 155 for the same purposes as that described herein.

It is thus seen that there has been provided mooring equipment which when not in use occupies a minimum amount of space and may be highly decorative. Preferably the device at a normal attitude stands at an angle of 25 degrees from the perpendicular and the massive base spring is structured so that it can readily bend down to the boat level in an elbow type action for attachment of its distal end and provides substantial lift at all times on the mooring lines which may be used as shown in FIG. 1. The arm does not swing onto the dock as when utilized one restraining line from the arm to the dock prevents it from swinging to the left and the other arm with its restraining line prevents it from swinging to the right. Thus, the arms can move with some freedom but not so far as to enable continuous pressures from currents or wind to push the boat into the dock. The spring loading of the arms themselves in the preferred embodiment shown in FIGS. 3 and 4 provide shock absorber benefits in response to inward pressure tending to move the boat toward the dock. The snap-on couplers on the distal end of the arms as at 129, generally are adapted to be attached to lines and the device provides a mooring which has substantial flexibility and when constructed of stainless steel provides substantial longevity and a highly decorative and desirable device which may be utilized not only at a dock but, also, on large yachts and heavy cruisers.

What is claimed is:

1. A boat mooring device comprising:

a base to be mounted to a support surface, said base having a lower surface to rest on a support surface and including an upstanding stem of a first predetermined length and diameter;

a coil spring of a length greater than said stem and with an inner end zone coiled about said stem and normally extending coaxially therefrom and including an intermediate zone and an outer zone;

means fixing said inner end zone to said base;

an elongate arm having an inner portion and an outer portion and said inner portion being of a diameter to mate within the outer zone of said spring and said inner portion being within the outer end zone of said spring;

means to fix the arm to the outer end zone of said spring;

the arm having an outer arm portion comprising a distal portion and a proximal portion, said distal portion including a first outer end and a second inner end and the proximal portion including a first outer end and a second inner end, means on the first end of said distal portion for connection with a boat, said proximal portion of said outer arm portion and said distal end of said inner arm portion being telescopically slidable with respect to one another, means for connecting the telescoping arms together at a predetermined position including diametrical holes through said proximal portion of said outer arm portion and a plurality of axially spaced diametrical holes through said inner arm portion and bolt and nut means sized for receipt through said holes to fix the axial position of said inner and outer arm portions at predetermined locations of extension;

said coil spring means intermediate zone comprising an elbow for bending of said arm relative to said stem.

2. The device as set forth in claim 1 wherein said outer arm portion includes shock absorber means.

3. The device as set forth in claim 2 wherein said shock absorber means comprises a first and second outer arm portions in telescopic engagement with one another and spring means within said outer arm portion constraining said proximal portion of said outer arm against the distal portion of said outer arm to a predetermined yieldable position with respect to said inner arm portion.

4. The device as set forth in claim 3 wherein said spring means comprises a first spring between said outer arm portion and said inner arm portion and adjacent the proximal end of said inner arm portion and within said inner arm portion and second spring means within said inner arm portion and captivated by an enlarged portion on said outer arm portion and the distal end of said inner arm portion distal portion includes a second inner enlarged end, said spring means comprising a first spring between said second inner end of said proximal portion and said second enlarged end of said distal portion and a second spring means between said first end of said proximal portion and the second enlarged end of said distal portion.

5. The device as set forth in claim 1 wherein dampener means are provided, said dampener means comprising a strip of rubbery material having a first end fixed to said base and a second end fixed to the arm adjacent said coil spring.

6. The device as set forth in claim 5 wherein said base includes an elongate vertically extending standard.

* * * * *